United States Patent [19]

Ploeg

[11] 4,194,702

[45] Mar. 25, 1980

[54] POWER REEL RETRIEVER

[76] Inventor: Andy M. Ploeg, 1825 Cook Rd., Burlington, Wash. 98233

[21] Appl. No.: 936,228

[22] Filed: Aug. 24, 1978

[51] Int. Cl.[2] ..... B65H 75/40

[52] U.S. Cl. ..... 242/86.5 R; 242/54 R; 242/66

[58] Field of Search ..... 242/86.5 R, 54 R, 66, 242/58.6, 68.7, 78.7

[56] References Cited

U.S. PATENT DOCUMENTS

| | | | |
|---|---|---|---|
| 1,602,450 | 10/1926 | Pritchard | 242/86.5 R |
| 2,266,446 | 12/1941 | Sluyter | 242/86.5 R |
| 2,679,987 | 6/1954 | Saliba | 242/66 |
| 3,325,118 | 6/1967 | Hall | 242/86.5 R |
| 3,379,392 | 4/1968 | Garnett | 242/86.5 R |
| 3,544,031 | 12/1970 | White | 242/86.5 R |
| 3,625,445 | 12/1971 | Hall | 242/86.5 R X |
| 3,934,854 | 1/1976 | Goode | 242/86.5 R X |
| 4,047,599 | 9/1977 | Rousseau | 242/86.5 R X |

*Primary Examiner*—Stanley N. Gilreath

[57] ABSTRACT

A cable winding reel drive apparatus especially adapted to reel in or pay out cable from a reel. The apparatus comprises a trailer assembly having a base frame, and mounted thereon a reel lifting and carrying device adapted to lift a loaded or unloaded reel to an operative position, a movable secondary frame adapted to move from a forward disengaged position to a rearward engaged position, a reel drive mechanism comprising pneumatic tires and retaining members mounted upon said secondary frame, and actuating means to move said secondary frame from the forward disengaged to the rearward engaged position. After the reel is secured within the reel lifting and carrying device, it is lifted by hydraulic jacks to an operative position wherein the secondary frame is moved rearwardly such that the reel drive mechanism engages the reel, whereupon cable may be reeled onto or payed out from the reel.

25 Claims, 6 Drawing Figures

POWER REEL RETRIEVER

BACKGROUND OF THE INVENTION

1. Field of the Invention

The present invention relates to cable winding devices, and more particularly a cable winding device adapted for field use to reel in and pay out electrical cable.

2. Description of the Prior Art

When heavy cable, such as that used in electrical transmission lines, is to be replaced, the old cable must be taken down and gathered for re-use or disposal, and the new cable must be paid out, usually from a large reel or spool upon which it is stored and transported. There are therefore two problems encountered; first, gathering a large quantity of bulky elongate material, and secondly, effectively controlling the rate at which the new cable is paid out.

Thus, one type of cable reel drive mechanism which will reel in and pay out at various speeds for different diameters of cable reels is that disclosed in U.S. Pat. No. 3,325,118, Hall. There is a base frame unit adapted to fit within the bed of a pick-up truck, which supports a pair of pivotally mounted lift arms, the free ends of which are adapted to receive a bar which extends through the cable reel and about which the reel rotates. The lift arms are lowered rearwardly to pick up a cable reel or spool, and then raised in a circular arc about the pivot connection by a hydraulic piston and cylinder to frictionally engage a transversly mounted roller, which is driven by a chain and sprocket. By activating the roller, the reel member is thereby rotated to reel in or pay out cable.

U.S. Pat. No. 3,625,445, Hall, relates to an improved cable winding mechanism having a frictionally engaging surface which has a plurality of fasteners which allow adjustment of wear surfaces, resulting in increased wear life of the wearing surface.

As another example of the prior art, U.S. Pat. No. 3,544,031, White, illustrates a wire roller apparatus designed for winding and unwinding lengths of wire used in making fences. A number of rows of wire from a supplier may be wound upon a reel of the apparatus, which may then be used for paying out the wire during the construction of the fence. A second embodiment is illustrated wherein an entire reel of wire may be removed from the apparatus. The apparatus may be adjusted to accept wire rolls of different widths.

U.S. Pat. No. 3,379,392, Garnet, discloses yet another cable reel trailer assembly which has a pair of rearwardly mounted reel supports, one at each side of a vertically movable frame. The supports receive the ends of a reel-supporting shaft at a lowered frame position, which ends are thereafter lifted to raise the reel to a transport or operative position. A hydraulic jack is provided to lower the rear portion of the trailer frame downwardly upon a rocker frame in order to engage the reel, and then raise the frame upwardly from the rocker frame.

A final example of the prior art is U.S. Pat. No. 4,047,599, Rousseau, which illustrates an electrically powered vehicle, such as a feed cart used in a barn, which utilizes a series of idler pulleys and levers to activate a friction drive wheel which rotates a reel. The reel winds up the electrical cord when it becomes slack so that it will not become entangled or soiled. If the cord is taut, upon reaching a predetermined stress, it causes disengagement of the friction drive wheel so that the reel may rotate and pay out more cord.

Because the weight of a substantial length of electrical able may be rather large, there is a need for an assembly which has the capability to not only pay out cable from a loaded reel at a slow rate, but which also is capable of reeling in a substantial length and weight of cable onto an empty reel. The assembly should also be capable of operating with older reels which are somewhat less than perfectly round with near-normal efficiency.

SUMMARY OF THE INVENTION

In the present invention, there is an apparatus adapted to carry a reel and to retrieve and pay out cable from said reel. The reel has a tubular drum portion and retaining flange members affixed to either end of the drum portion, the flange members having a larger diameter than the tubular drum portion. A base frame has fixedly mounted thereto a reel lifting and carrying device which is adapted to vertically lift the reel from a first lower position to a second upper operative position. Movably affixed to the base frame is a secondary frame which is adapted to move from a forward disengaged position to a rearward engaged position along a longitudinal axis of the base frame. A reel drive mechanism having transversely spaced drive elements, each of which has a rotating friction drive surface, is adapted to frictionally engage the flange members of the reel to cause the reel to rotate. There is also an actuating means which is positioned to move the movable secondary frame from the disengaged forward position to the engaged rearward position, such that the drive members engage the reel flange members. Thereby, upon actuation of the actuating means, the secondary frame is moved rearwardly with the drive elements engaging the reel and providing effective driving engagement when the reel is either loaded or unloaded with cable.

The reel lifting and carrying device further comprises a pair of vertically oriented slideway members spaced laterally from one another and fixedly mounted to the base frame, and a pair of vertically oriented lifting members, each of which has a plurality of vertically spaced receiving areas adapted to receive the end of a shaft about which the reel rotates. There are power means in the form of two hydraulic jacks, each having a cooperating piston and cylinder operatively connecting its lifting member and the base frame. A pair of compression springs are provided to dampen shocks produced on a rough roadway.

The drive elements are provided in the form of pneumatic tires and have circumferential retaining members of a larger diameter positioned on either side of the pneumatic tire such that they define with each tire a circumferential recess adapted to receive and maintain a related retaining flange of the reel in frictional engagement.

The drive elements are each provided with a mounting sleeve which interfits with a drive axle rotatably mounted to the movable secondary frame for rotation about a horizontal transverse axis. The drive elements are adjustably mounted to the drive axle and each mounting sleeve has a securing means thereon to secure that mounting sleeve and its drive member at any position on the drive axle.

There is also provided a stationary mounting frame which is fixedly connected to the base frame and which comprises a plurality of channel members aligned along the longitudinal axis of the base frame. The movable secondary frame has wheels mounted thereto and positioned for travel within the channel members of the stationary frame from the first forward disengaged position to the second rearward engaged position.

The actuating means comprises a hydraulic jack, with either the piston or cylinder being fixedly mounted to the base frame at a forward location, while the other is fixedly mounted to the movable secondary frame at a rearward location, such that upon actuation of the actuating means, the movable secondary frame is moved from a forward disengaged position to a rearward operative position. The movable secondary frame also contains thereon a motor, a chain and sprocket drive means operatively connected to the motor, and a transmission. Therefore, when the movable secondary frame is moved rearwardly, the motor and drive means are moved rearwardly also.

DESCRIPTION OF THE PREFERRED EMBODIMENT

Figure 1:
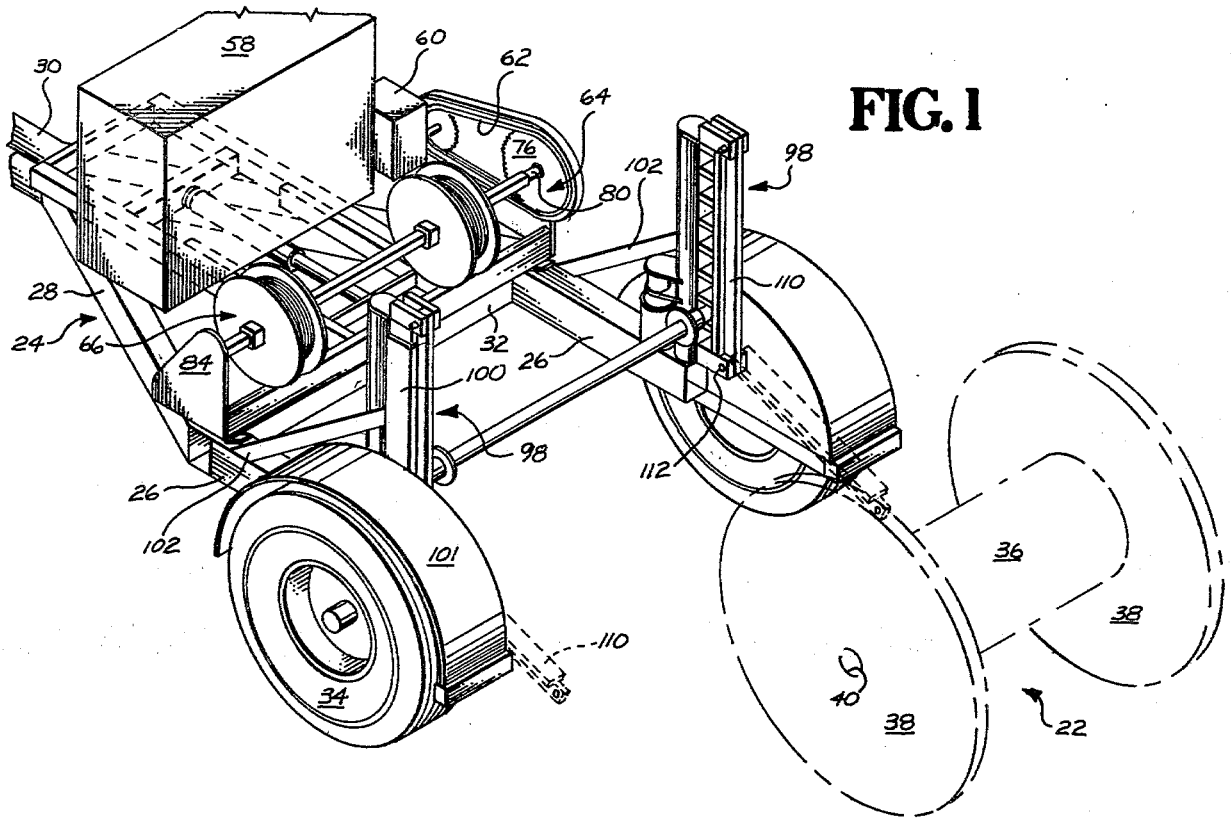
FIG. 1 is an isometric view illustrating the present invention with a reel in place prior to being mounted onto the trailer of the present invention.

As shown in FIG. 1, there is a power reel trailer 20, as it would appear prior to loading a reel or spool, shown in broken lines at 22. A quantity of cable, such as electrical transmission line or telephone cable, is wound upon the spool 22 either before or after being mounted upon the trailer 20. The trailer 20 has, generally, a base frame 24, comprised of a pair of parallel base support members 26 at the rear end of the trailer, a pair of forwardly converging base support members 28, and a tongue portion 30 at the front of the trailer upon which is mounted a trailer hitch of conventional design. The base frame 24 is constructed of extremely heavy gauge tubular iron or I-beams to support the substantial weight of a loaded reel. There are one or more transverse base support members 32 which interconnect the members 26 and 28. There are also a pair of rearwardly positioned wheels 34 mounted to the base support members 26.

The reel or spool 22 typically has a central drum portion 36 upon which the cable is wound, and a pair of circular retaining members 38 on either end of the spool which maintain a length of cable wound upon the spool 22. There is a through hole 40 which accepts a shaft 42 about which the reel 22 rotates.

Mounted above the base frame 24 is a movable secondary frame 44, which moves along the longitudinal axis of the trailer 20 from a forward position to a rearward position. There is a stationary secondary frame 46 mounted along the longitudinal axis of the trailer 20 above the base frame 24, which acts as a guide for the movement of the movable secondary frame 44. The stationary secondary frame 46 comprises a pair of channel retaining members 48 aligned along the longitudinal axis and parallel to one another, with the open channel portion of each retaining member 48 facing inwardly toward the other member 48. The retaining members 48 are welded to the base frame at 50 and 52 and are interconnected by one or more transversely positioned members 54 which maintain the retaining members 48 at a predetermined width.

The movable secondary frame 44 consists of parallel elongate members 56 aligned along the longitudinal axis of the trailer 20 and positioned immediately inside the retaining members 48. Mounted to the frame 44 immediately above the members 56 are the components which travel with the movable frame 44, namely a motor shown schematically at 58, a transmission 60, a chain 62 and sprocket 64 drive means, and two drive members 66. There are roller bearings 68 provided to facilitate the movement of the movable frame 44 within the stationary frame 46 from its forward position to its rearward position, which may most economically be provided in the form of wheels mounted to the outer facing surface of the members 56 of the movable frame 44. The wheels 68 are positioned within the open channel 69 of the retaining members 48, such that they may roll with the movable frame 44 but will be prevented from lateral movement in either direction by abutting against the interfacing wall of the retaining member 48.

The motive force for the movement of the movable frame 44 from a forward to a rearward position is provided by a hydraulic jack made up of a piston 70 and cylinder 71. The cylinder 71 is mounted at a forward location 72 to a transverse member 54 of the stationary secondary frame 46, and at a rearward location to a transverse member 74 interconnecting the elongate members 56 of the movable secondary frame 44. In this manner, by extending the piston 70, the movable frame 44 is pushed rearwardly with the wheels 68 rolling within the retaining members 48.

As mentioned above, there are mounted upon the movable secondary frame 44 a power source 58, such as a gasoline engine, a transmission or gear box 60, and a chain 62 and sprocket 64 drive means. The rearward sprocket 76 is rotatably mounted at its outer facing side to an upstanding flange 78 mounted to the frame 44, and on its inner-facing side it is provided with a mounting flange 80. The flange 80 interfits with one end of a rectangularly shaped transversely aligned horizontal drive axle 82, and provides the driving force for the axle 82. The other end of the axle 82 is rotatably mounted in a second flange 84 attached to the secondary frame 44. Slidably arranged on the drive axle 82 are the two drive members 66, which are comprised generally of two automobile wheels 86 with pneumatic tires 88 thereon, each having a pair of circular retaining members 90, one on either side of the tire 88 and closely adjacent thereto. The two retaining members 90 of each drive member 66 are connected to one another by a rectangular shaped mounting sleeve 92 which is slidably mounted on the axle 82 and extends through an opening in the hub of the wheel 86, and which is sized to engage the axle 82 and its related wheel 86 in driving relationship. The sleeve 92 extends laterally beyond the outer edge of the retaining members 90 to provide a retaining collar in which is threaded a set-screw 96. The set-screw 96 provides an easily adjustable mechanism which will secure its related member 66 at any convenient location on the drive axle 82 as determined by the size of reel 22 utilized.

At the rearward end of the trailer 20 there are a pair of opposed vertically disposed reel lifting and carrying members 98. Each of these members 98 is slide mounted for vertical movement in a vertically oriented stationary slideway member 100 welded at its lower end to the base frame member 26. Each slideway member 100 is desirably in the form of a U-shaped channel member which faces inwardly. Each slideway member 100 is welded along its lower portion to the wheel well 101 and at its upper edge portion to the rear end of a diagonally oriented supporting member 102, which is welded at its forward location to the base frame 26. Each reel lifting and carrying member 98 is welded at its upper end to the upper end of a vertically oriented hydraulic jack 103 made up of a lower piston 104 and an upper cylinder 106 to which the member 98 is welded. The lower end of each piston 104 is welded to the frame 24 just forward of the connecting location of its related slideway member. The two jacks 103 move the members 98 vertically and help to maintain them in a vertical position.

Each member 98 provides a plurality of vertically arrayed receiving areas 108, each of which is constructed as a five-sided member having no inwardly facing wall. The rearwardly facing wall of each area 108 is comprised of a removable gate 110 hinge-mounted at its lower end at 112 to the lower end of its related member 98. Each gate 110 may be swung rearwardly and downwardly to expose each of the receiving areas 108. Each gate 110 may be secured at its upper end to the upper end of the member 98 with a pin 114. The top and bottom of each receiving area 108 (except for the uppermost and lowermost receiving area) are defined by horizontal plate members 116 welded to the front and outer facing walls 118 and 120 respectively of its related member 98. These two walls 118 and 120 are joined one to another in the form of a vertically oriented angle iron having two flanges at right angles to one another. In order to secure a reel-supporting shaft 42 within the receiving area 108, the gate 110 is lowered as shown in broken lines in FIG. 1, a reel 22 with a shaft 42 therethrough is rolled between the members 98 (or the trailer 20 is backed into position around a reel 22) with the shaft 42 coming into opposing receiving areas 108 of each member 98. The gate 110 is thereafter raised and secured with the pin 114 so that the shaft 42 is retained securely within the receiving area 108.

There is for each jack 103 a spring member 122 contained within a housing 124 which is hinge-mounted at 126 to the base frame 26 at a location just forward of its related jack 103. An upper compressing member 128 is fixedly attached to each cylinder 106 and is positioned to rest on the upper end of its spring member 122, so that when a roll of wire is being transported, the members 98 will be free to bounce and compress the spring 122 in order to ameliorate the effects of a rough roadway, without transmitting shock loads to the jacks 103. The spring housing 124, with the spring 122 therein, may be pivoted forwardly about hinge 126 so that the lifting and carrying member 98 may be lowered to the lowest possible position, wherein the compressing member 128 will be in contact with the base frame 26.

The vertically adjustable nature of the reel lifting and carrying members 98 is necessary in order to utilize reels of varying size. If a relatively small reel is to be used, having small-diameter retaining flanges 38 with a through hole 40 relatively close to the ground, the members 98 may be lowered (possibly pivoting the spring housing 124 forwardly out of the way) so that the reel 22 may be rolled between the members 98 with the shaft 42 engaging opposing receiving areas 108. The reel 22 may thereafter be lifted into operative position for transport or use. This system provides a much easier method than attempting to lift the reel 22 into position onto stationary support members. Additionally, after an average sized reel 22 is locked into position within receiving area 108, it must be raised out of contact with the ground in order to transport the reel or to reel in or pay out cable.

Figure 2:
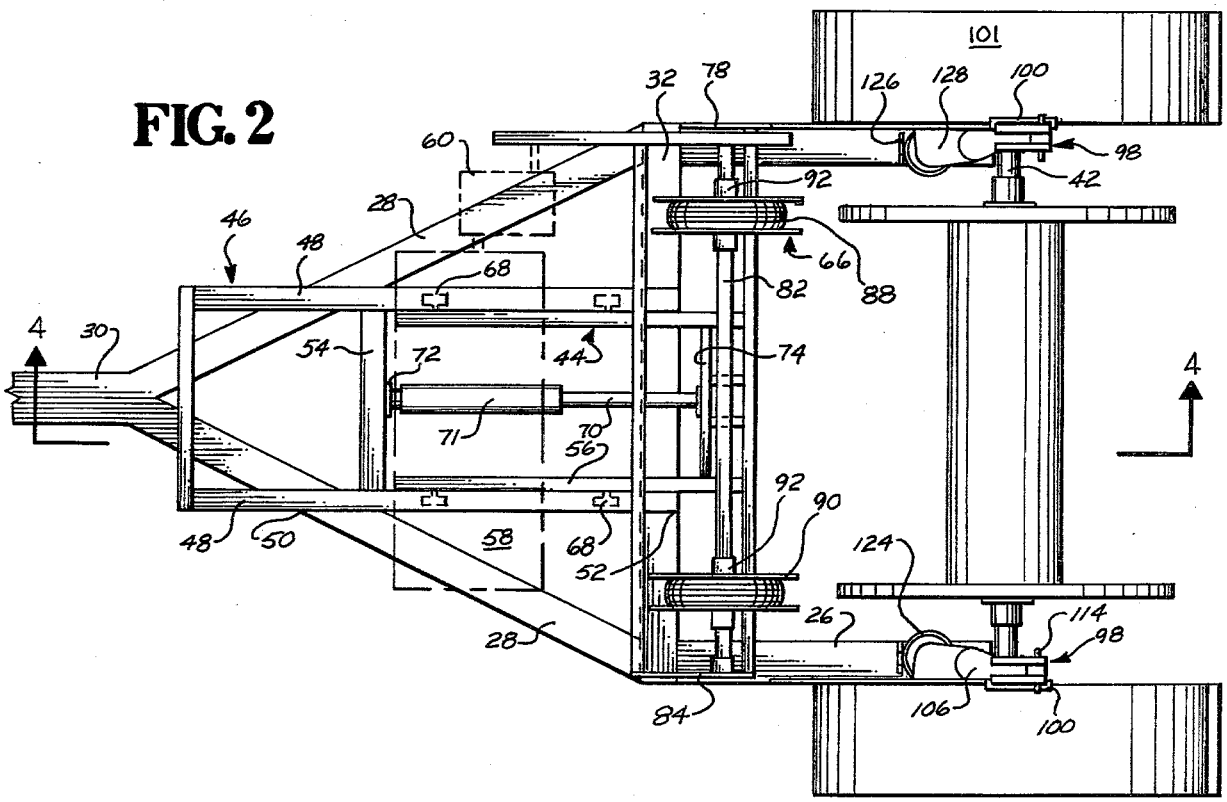
FIG. 2 is a top plan view of the present invention in an inoperative condition.
Figure 3:
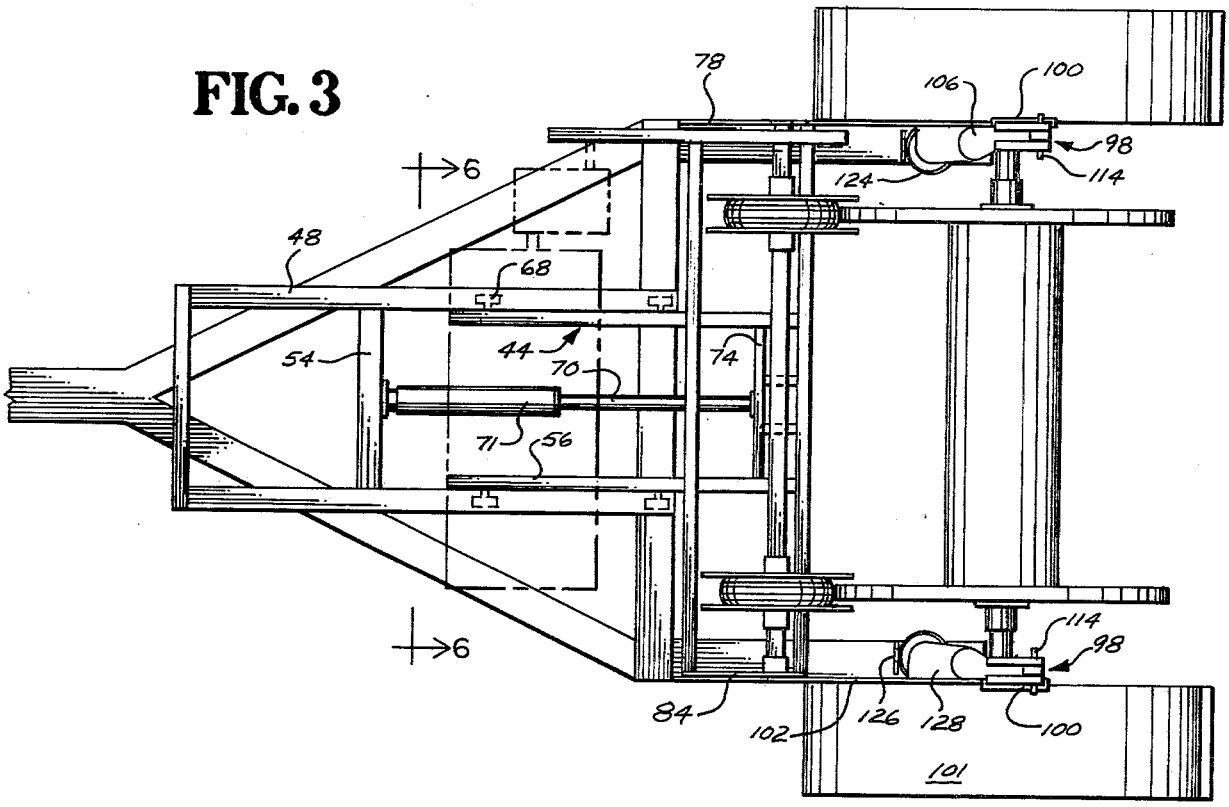
FIG. 3 is a top plan view of the present invention in an operative condition.

The operation of the present invention is extremely simple and efficient, permitting a large quantity of heavy wire or cable to be reeled onto or paid off of a spool 22 at any speed or tension desired by the operator. After the shaft 42 has been secured within the appropriate receiving area 108 as described previously herein, the members 98 are raised by activating the two jacks 103, placing the reel 22 in the operative position shown in broken lines in FIG. 4. Thereafter, the movable secondary frame 44 is moved rearwardly to effect engagement of the drive members 66 and the reel flange members 22 to either reel in or pay out wire or cable as shown in FIG. 3. The hydraulic piston 70 is activated and extended from the cylinder 71, thereby pushing against the transverse member 74 and moving the entire movable frame 44 rearwardly. The frame 44 may be seen in its forward disengaged position with the piston 70 in its retracted position in FIG. 2, and in its rearward engaged position with the piston 70 extended in FIG. 3. The movement from the forward to the rearward position is facilitated by the movable frame 44 sliding on roller bearings or wheels 68 within the channel retaining members 48 of the stationary frame 46. There is a skid plate 132 affixed to the bottom of the transverse member 74 which slides along base member 26. The skid plate 132 has an upturned rearwardly facing lip 130 to aid in the rearward movement of the movable frame 44.

Figure 5:
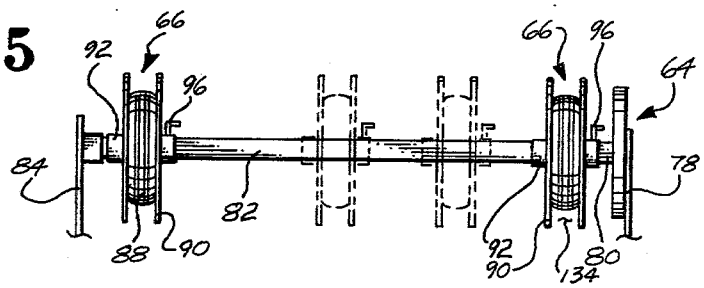
FIG. 5 is an isometric view illustrating the drive members of the present invention in various positions.
Figure 6:
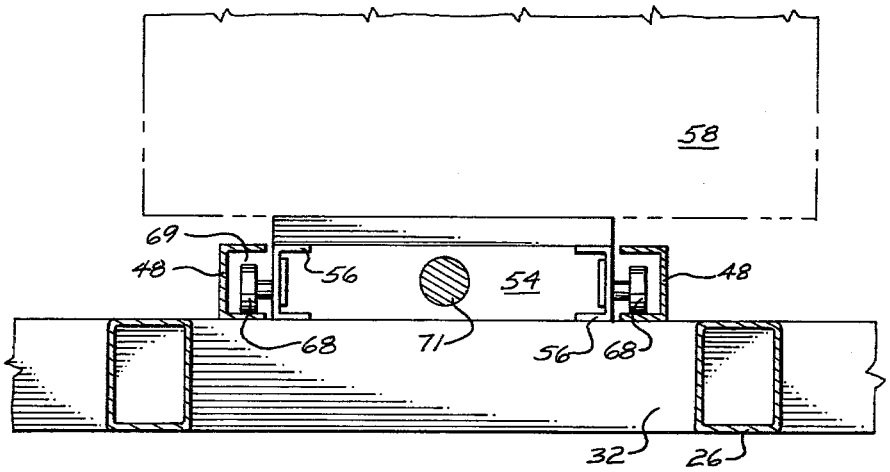
FIG. 6 is a transverse sectional view taken along line 6—6 of FIG. 3.

The movable frame 44 is moved rearwardly until the drive members 66 frictionally engage the retaining flange members 38 of the reel 22 with sufficient force to cause rotation of the reel with the desired speed. As illustrated in FIG. 5, the drive members 66 may be adjusted laterally along the drive axle 82 and secured thereto with set screw 96 at the appropriate location to engage the circumferential edge of the retaining member 38. The retaining members 90 of each drive member 66 and the pneumatic tire 88 define a circumferential engagement area or recess 134 which is of sufficient width and depth to maintain the retaining members 38 in contact with the tires 88 even though the retaining members 38 may be less than perfectly round. The compressible nature of the pneumatic tire 88, when in the operative position and in engagement with the retaining members 38, allows a constant driving force to be applied to the reel 22, as well as maintaining smooth rotation of the reel 22 about the shaft 42 even though the retaining members 38 may be misshapen to a small degree.

Figure 4:
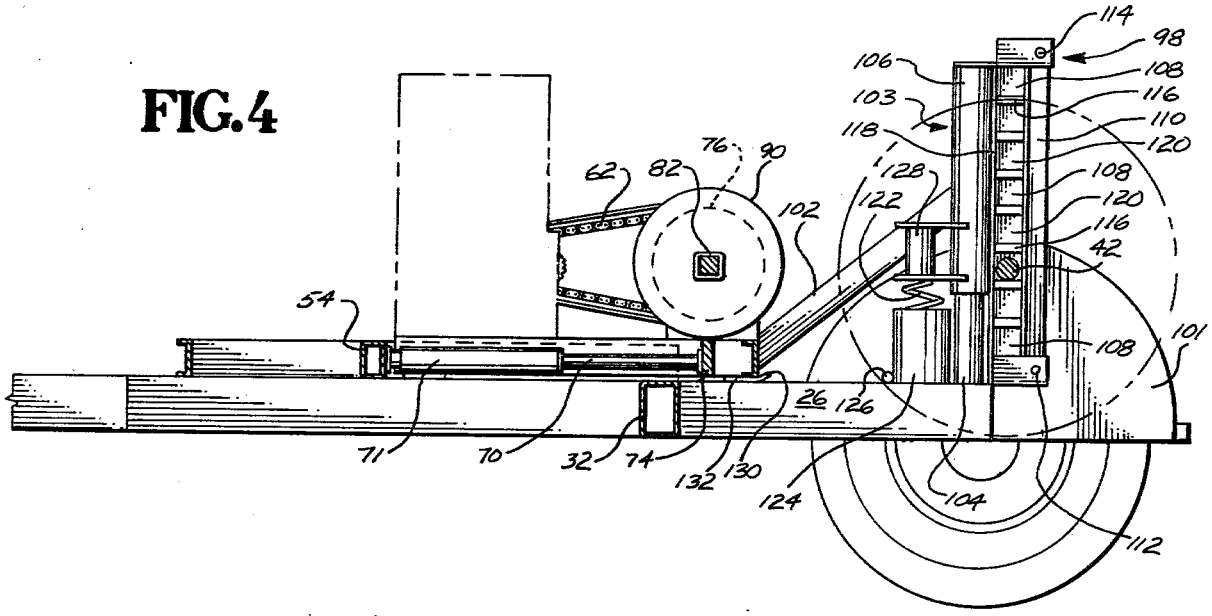
FIG. 4 is a longitudinal sectional view taken along line 4—4 of FIG. 2.

If the operator is unable to obtain sufficient frictional engagement of the drive members 66 to reel in a particularly heavy load of cable by simply engaging the reel retaining members 38 with the drive member 66 by extending the piston and cylinder assembly 70-71, the present invention offers a unique method of obtaining a substantial increase in the frictional engagement. With the reel 22 retained in the upright members 98 and either lowered below or raised above the position illustrated in FIG. 4, the secondary movable frame 44 may be moved rearwardly to a position closely adjacent to the position of the normal engagement position of FIG. 3. The reel 22 is then raised or lowered as the case may be, to the position necessary to fully engage the pneumatic tires 88 with the retaining members 38 as shown in FIG. 4. By so doing, the retaining members 38 will compress the tires 88 to a degree unobtainable by simply moving the frame 44 rearwardly into engagement with the members 38. This resulting wedging action between the members 66 and the reel flanges 38 enables the operator to reel in cable which may otherwise require cutting into smaller segments, thereby resulting in a significant savings of time and money.

What is claimed is:

1. An apparatus to carry a reel, said reel having a drum portion having a relatively small diameter and retaining flange members having a relatively larger diameter affixed to either end of said drum portion, said apparatus adapted to retrieve and pay out cable from said reel, said apparatus comprising:

a. a base frame having a forward end and a rear end, and longitudinal and transverse axes, and a stationary mounting frame fixedly connected to said base frame, said stationary mounting frame comprising a plurality of guide members, said guide members being provided in the form of channel members aligned along said longitudinal axis, b. a reel lifting and carrying device mounted to said base frame, said device being adapted to vertically lift said reel from a first lower position to a second upper operative position, said device further comprising:

1. a pair of vertically oriented slideway members mounted to said base frame and spaced laterally from one another so as to be able to receive therebetween said reel, 2. a pair of lifting members mounted one to each of said slideway members for vertical movement relative to said slideway members, each of said lifting members having a related reel engaging members, and 3. power means to move said lifting members vertically relative to said slideway members to lift said reel to said second upper operative position, c. a movable secondary frame operatively connected to said base frame and adapted for movement from a forward disengaged position to a rearward engaged position along said longitudinal axis of said base frame, said movable frame having wheels mounted thereto and positioned for longitudinal travel within said channel members of said stationary mounting frame from a first forward disengaged position to a second rearward engaged position, d. a reel drive mechanism, comprising transversely spaced drive elements having rotating friction drive surfaces adapted and positioned to frictionally engage said reel to cause said reel to rotate, said drive elements being mounted to said secondary frame, said drive elements comprising pneumatic tires mounted to said movable secondary frame for rotation about a transversely aligned horizontal axis of rotation, said drive elements further comprising circumferential retaining members having a diameter greater than that of said pneumatic tires, wherein said retaining members and each pneumatic tire defined a circumferential recess adapted to receive and maintain a related retaining flange of said reel in frictional engagement with said drive member, said reel drive mechanism further comprising a drive axle rotatably mounted to said movable secondary frame, wherein said drive elements are slideably engaged on said drive axle by means of mounting sleeves, said mounting sleeves each having one or more securing means adapted to secure said mounting sleeves to said drive elements at any position on said drive axle, e. actuating means adapted to move said secondary frame from said disengaged forward position to said engaged rearward position where said drive surfaces engage said reel, said actuating means comprising a hydraulic piston and cylinder mounted for movement along said longitudinal axis, one of said cylinder and piston being fixedly mounted to said base frame at a forward location, and the other of said piston and cylinder being fixedly mounted to said movable secondary frame at a rearward location, whereby, upon actuation of said actuating means, said secondary frame is moved rearwardly to said operative position, such that said pneumatic drive elements engage the retaining flange of said reel, with said drive elements being adapted to provide effective driving engagement with said reel under loaded or unloaded reel conditions.

2. The apparatus as recited in claim 1, wherein said reel lifting and carrying device further comprises:

a. each lifting member comprises a plurality of vertically spaced engaging members adapted to engage reels at either upper or lower engaging locations, said engaging members comprising vertically spaced plates defining therebetween a plurality of vertically spaced recesses adapted to receive one end of a carrying member for said reel, b. a pair of gate members connected to said lifting members and movable between open and closed positions to permit engagement of a reel holding member in a selected recess, c. a pair of hydraulic jacks, mounted one to each of said lifting members to move said lifting members between said lower and upper positions, d. a pair of spring members mounted to said base frame and adapted to engage a related lifting member so as to support said related lifting member at a predetermined location, whereby upon positioning of a reel with holding members between said lifting members, the holding members of the reel can be received in related recesses, the gate closed, and the hydraulic jack actuated to raise said lifting members and move said reel to its upper operative position, and said reel can be carried in said lifting members with vertical loads on said jacks being carried by said spring members.

3. An apparatus to carry a reel, said reel having a drum portion having a relatively small diameter and retaining flange members having a relatively larger diameter affixed to either end of said drum portion, said apparatus adapted to retrieve and pay out cable from said reel, said apparatus comprising:

a. a base frame having a forward end and a rear end, and longitudinal and transverse axes, b. a reel lifting and carrying device mounted to said base frame, said device being adapted to vertically lift said reel from a first lower position to a second upper operative position, c. a movable secondary frame operatively connected to said base frame and adapted for movement from a forward disengaged position to a rearward engaged position along said longitudinal axis of said base frame, d. a reel drive mechanism, comprising transversely spaced drive elements having rotating friction drive surfaces adapted and positioned to frictionally engage said reel to cause said reel to rotate, said drive elements being mounted to said secondary frame, e. actuating means adapted to move said secondary frame from said disengaged position to said engaged position where said drive surfaces engage said reel, f. said reel lifting and carrying device further comprising:

1. a pair of vertically oriented slideway members mounted to said base frame and spaced laterally from one another so as to be able to receive therebetween said reel, 2. a pair of lifting members mounted one to each of said slideway members for vertical movement relative to said slideway members, each of said lifting members having a related reel engaging means, and 3. power means to move said lifting members vertically relative to said slideway members to lift said reel to said second upper operative position, whereby, upon actuation of said actuating means, said secondary frame is moved rearwardly, such that said drive elements engage said reel, with said drive elements being adapted to provide effective driving engagement with said reel under loaded or unloaded reel conditions.

4. The apparatus as recited in claim 3, wherein each lifting member comprises a plurality of vertically spaced engaging members adapted to engage reels at either upper or lower engaging locations, so that said lifting members are able to engage reels of greater or lesser diameters.

5. The apparatus as recited in claim 4, wherein the engaging members of each lifting member comprises vertically spaced plates defining therebetween a plurality of vertically spaced recesses adapted to receive one end of a carrying member for said reel.

6. An apparatus to carry a reel, said reel having a drum portion having a relatively small diameter and retaining flange members having a relatively larger diameter affixed to either end of said drum portion, said apparatus adapted to retrive and pay out cable from said reel, said apparatus comprising:

a. a base frame having a forward end and a rear end, and longitudinal and transverse axes, b. a reel lifting and carrying device mounted to said base frame, said device being adapted to vertically lift said reel from a first lower position to a second upper operative position, c. a movable secondary frame operatively connected to said base frame and adapted for movement from a forward disengaged position to a rearward engaged position along said longitudinal axis of said base frame, d. a reel drive mechanism, comprising transversely spaced drive elements having rotating friction drive surfaces adapted and positioned to frictionally engage said reel to cause said reel to rotate, said drive elements being mounted to said secondary frame, e. actuating means adapted to move said secondary frame from said disengaged position to said engaged position where said drive surfaces engage said reel, whereby, upon actuation of said actuating means, said secondary frame is moved rearwardly, such that said drive elements engage said reel, with said drive elements being adapted to provide effective driving engagement with said reel under loaded or unloaded reel conditions, said reel lifting and carrying device further comprising:

a. a pair of vertically oriented slideway members fixedly mounted to said base frame, b. a pair of vertically oriented lifting members, each mounted for vertical movement to a related slideway member between lower and upper positions, each of said lifting members comprising:

1. vertically oriented wall means defining a vertically aligned open area, 2. a plurality of vertically spaced plate members mounted in said vertically aligned area to separate said vertically aligned area into a plurality of vertically spaced recesses, each adapted to receive an end portion of a reel holding member, 3. a gate member connected to said lifting member and movable between open and closed positions to permit engagement of a reel holding member in a selected recess, and retention of said reel holding member when said gate member is in its closed position, c. a pair of hydraulic jacks, mounted one to each of said lifting members to move said lifting members between their lower and upper positions, whereby upon positioning of a reel with holding members between said lifting members, the holding members of the reel can be received in related recesses, the gate closed, and the hydraulic jack actuated to raise said lifting members and move said reel to its upper operative position.

7. The apparatus as recited in claim 6, further comprising a pair of spring members, each mounted to said base frame and adapted to engage a related lifting member so as to support said related lifting member at a predetermined location, whereby a reel can be carried in said lifting members with vertical loads on said jacks being carried by said spring members.

8. The apparatus as recited in claim 7, wherein each of said spring members are movably mounted between a first engaging position and a second disengaging position, whereby when it is desired to lower said lifting members to their first lower positions, said spring members may be moved to the second disengaged position and do not interfere with the lowering of the lifting members.

9. An apparatus to carry a reel, said reel having a drum portion having a relatively small diameter and retaining flange members having a relatively larger diameter affixed to either end of said drum portion, said apparatus adapted to retrieve and pay out cable from said reel, said apparatus comprising:

a. a base frame having a forward end and a rear end, and longitudinal and transverse axes, b. a second reel supporting frame mounted to said base frame c. a reel lifting and carrying device mounted to said second frame, said device being adapted to vertically lift said reel from a first lower position to a second upper operative position, d. a movable third frame operatively connected to said base frame and adapted for movement from a forward disengaged position to a rearward engaged position along said longitudinal axis of said base frame, e. a reel drive mechanism, comprising transversely spaced drive elements having rotating friction drive surfaces adapted and positioned to frictionally engage said reel to cause said reel to rotate, said drive elements being mounted to said third frame, f. actuating means adapted to move said third frame from said disengaged position to said engaged position where said drive surfaces engage said reel, g. said reel lifting and carrying device being mounted to said second frame, such that movement of said lifting and carrying device is vertical relative to both said second and third frames, whereby, upon actuation of said actuating means, said third frame is moved rearwardly, such that said drive elements engage said reel, and said reel can be moved independently of movement of said third frame, with said drive elements being adapted to provide effective driving engagement with said reel under loaded or unloaded reel conditions.

10. The apparatus as recited in claim 9, said second frame comprises a pair of vertically oriented slideway members mounted to said base frame and spaced laterally from one another so as to be able to receive therebetween said reel, and said reel lifting and carrying device comprises a pair of lifting members mounted one to each of said slideway members for vertical movement relative to said slideway members, each of said lifting members having a related reel engaging means, and power means to move said lifting members vertically relative to said slideway members to lift said reel to said second upper operative position.

11. The apparatus as recited in claim 10, wherein each lifting member comprises a plurality of vertically spaced engaging members adapted to engage reels at either upper or lower engaging locations, so that said lifting members are able to engage reels of greater or lesser diameters.

12. The apparatus as recited in claim 11, wherein the engaging members of each lifting member comprises vertically spaced plates defining therebetween a plurality of vertically spaced recesses adapted to receive one end of a carrying member for said reel.

13. The apparatus as recited in claim 9, wherein a. said second frame comprises a pair of vertically oriented slideway members fixedly mounted to said base frame, b. said reel lifting and carrying device comprises a pair of vertically oriented lifting members, each mounted for vertical movement to a related slideway member, each of said lifting members comprising:

1. vertically oriented wall means defining a vertically aligned open area, 2. a plurality of vertically spaced plate members mounted in said vertically aligned area to separate said vertically aligned area into a plurality of vertically spaced recesses, each adapted to receive an end portion of a reel holding member, 3. a gate member connected to said lifting member and movable between open and closed positions to permit engagement of a reel holding member in a selected recess, and retention of said reel holding member when said gate member is in its closed position, c. said reel lifting and carrying device also comprises a pair of hydraulic jacks, mounted one to each of said lifting members to move said lifting members between their lower and upper positions, whereby upon positioning of a reel with holding members between said lifting members, the holding members of the reel can be received in related recesses, the gate closed, and the hydraulic jack actuated to raise said lifting members and move said reel to its upper operative position.

14. The apparatus as recited in claim 13, further comprising a pair of spring members, each mounted to said base frame and adapted to engage a related lifting member so as to support said related lifting member at a predetermined location, whereby a reel can be carried in said lifting members with vertical loads on said jacks being carried by said spring members.

15. The apparatus as recited in claim 14, wherein each of said spring members are movably mounted between a first engaging position and a second disengaging position, whereby when its is desired to lower said lifting members to their first lower positions, said spring members may be moved to the second disengaged position and do not interfere with the lowering of the lifting members.

16. The apparatus as recited in claim 9, wherein said drive elements comprise pneumatic tires mounted to said movable secondary frame for rotation about a transversely aligned horizontal axis of rotation.

17. The apparatus as recited in claim 16, wherein said drive elements further comprise circumferential retaining members, positioned on opposite sides of each pneumatic tire.

18. The apparatus as recited in claim 17, wherein said retaining members have a diameter at least moderately greater than that of said pneumatic tires, wherein said retaining members and each pneumatic tire define a circumferential recess adapted to receive and maintain a related retaining flange of said reel in frictional engagement with said drive member.

19. The apparatus as recited in claim 18, wherein said drive elements are each provided with a mounting sleeve with a non-circular through hole, said apparatus further comprising a drive axle extending through said mounting sleeves in driving engagement therewith.

20. The apparatus as recited in claim 9, wherein said reel drive mechanism further comprises a drive axle rotatably mounted at first and second ends thereof to said movable secondary frame at a horizontal axis of rotation, said drive elements being adjustably mounted to said drive axle to accommodate reels of different widths.

21. The apparatus as recited in claim 20, wherein said drive axle has a generally non-circular cross-sectional configuration adapted to interfit with said drive elements.

22. The apparatus as recited in claim 21, wherein said drive elements further comprise mounting sleeves and said drive elements are slidably engaged on said drive axle by means of said mounting sleeves, said mounting sleeves each having one or more securing means adapted to secure said mounting sleeves and said drive elements at any position on said drive axle.

23. The apparatus as recited in claim 9, comprising a fourth stationary mounting frame fixedly connected to said base frame, said fourth stationary mounting frame comprising a plurality of guide members, said guide members being provided in the form of channel members aligned along said longitudinal axis, said third frame having wheels mounted thereto and positioned for longitudinal travel within said channel members from said first forward disengaged position to said second rearward engaged position.

24. The apparatus as recited in claim 9, wherein said actuating means comprises a hydraulic piston and cylinder mounted for movement along said longitudinal axis, one of said cyliner and piston being fixedly mounted to said base frame at a forward location, and the other of said piston and cylinder being fixedly mounted to said third frame at a rearward location, wherein upon actuation of said actuating means said third frame is moved from a forward disengaged position to a rearward engaged position.

25. The apparatus as recited in claim 24, wherein said apparatus further comprises a motor mounted to said third frame, a chain and sprocket drive means operatively connected to said motor, and a drive axle mounted for rotation about a transverse horizontal axis of rotation, one end of said drive axle being operatively connected to said chain and sprocket means, said drive elements affixed to said drive axle, wherein upon actuation of said actuating means said third frame is moved rearwardly to bring said drive elements into frictional engagement with a related flange of said reel, and upon actuation of said power source, said drive elements are rotated about said transverse horizontal axis of rotation and said drive elements cause rotational movement of said reel.

* * * * *